US012286318B2

(12) United States Patent
Duperray et al.

(10) Patent No.: US 12,286,318 B2
(45) Date of Patent: Apr. 29, 2025

(54) DENESTING APPARATUS

(71) Applicant: Anheuser-Busch InBev S.A., Brussels (BE)

(72) Inventors: Philippe Jean Marie Duperray, Châteauroux (FR); Wim Dekocker, Leuven (BE)

(73) Assignee: ANHEUSER-BUSCH INBEV S.A., Brussels (BE)

( * ) Notice: Subject to any disclaimer, the term of this patent is extended or adjusted under 35 U.S.C. 154(b) by 346 days.

(21) Appl. No.: 17/631,270

(22) PCT Filed: Jul. 29, 2020

(86) PCT No.: PCT/EP2020/071431
§ 371 (c)(1),
(2) Date: Jan. 28, 2022

(87) PCT Pub. No.: WO2021/018979
PCT Pub. Date: Feb. 4, 2021

(65) Prior Publication Data

US 2022/0250862 A1 Aug. 11, 2022

(30) Foreign Application Priority Data

Jul. 30, 2019 (EP) ..... 19189073
Dec. 27, 2019 (EP) ..... 19219765

(51) Int. Cl.
*B65H 1/14* (2006.01)
*B65H 1/26* (2006.01)
(Continued)

(52) U.S. Cl.
CPC ..... *B65H 1/263* (2013.01); *B65H 1/14* (2013.01); *B65H 1/28* (2013.01); *B65H 3/0816* (2013.01);
(Continued)

(58) Field of Classification Search
CPC . B65H 1/263; B65H 1/14; B65H 1/28; B65H 3/0816; B65H 3/36; B65H 3/44; B65H 2301/4472; B65H 2406/344
See application file for complete search history.

(56) References Cited

U.S. PATENT DOCUMENTS 2,358,292 A 9/1944 Malhiot
3,401,831 A 9/1968 Saurenmann
(Continued)

FOREIGN PATENT DOCUMENTS

BE 1027586 B1 4/2021
BR PI0923133 B1 6/2019
(Continued)

OTHER PUBLICATIONS

International Preliminary Report on Patentability for Application No. PCT/EP2020/071431 dated Feb. 10, 2022 (9 pages).
(Continued)

*Primary Examiner* — Howard J Sanders
(74) *Attorney, Agent, or Firm* — ArentFox Schiff LLP

(57) ABSTRACT

The present invention provides a denesting apparatus (100, 200), the apparatus comprising: •—one or more closed loop conveying tracks (130, 230), each closed loop conveying track comprising a plurality of sets of one or more de-stacking means (140, 240) movingly configured thereon through one or more de-stacking means moving mechanism (150, 250): •—one or more stacking magazines (120, 220), each adapted to hold a stack of sheets (110, 210) supported thereon: wherein each of the plurality of sets of de-stacking means is adapted to selectively engage an uppermost sheet from at least one of the stacking magazines in any desired order either sequentially and/or simultaneously so as to discharge the picked-up sheets onto an out-feed conveyor
(Continued)

(180, 280) in any desired manner either one besides another or otherwise one overlapping the other.

6 Claims, 10 Drawing Sheets

(51) Int. Cl.
*B65H 1/28* (2006.01)
*B65H 3/08* (2006.01)
*B65H 3/36* (2006.01)
*B65H 3/44* (2006.01)

(52) U.S. Cl.
CPC ..... *B65H 3/36* (2013.01); *B65H 3/44* (2013.01); *B65H 2301/4447* (2013.01); *B65H 2301/4472* (2013.01); *B65H 2406/344* (2013.01)

(56) References Cited

U.S. PATENT DOCUMENTS 3,555,776 A 1/1971 Nigrelli et al.
3,601,246 A 8/1971 Dubois
3,815,320 A 6/1974 Ganz
4,038,807 A 8/1977 Beardsley
4,191,003 A 3/1980 Talarico
4,641,742 A 2/1987 Igarashi et al.
5,011,126 A 4/1991 Suzuki et al.
5,237,468 A 8/1993 Ellis
5,254,071 A 10/1993 Laroche
5,261,520 A 11/1993 Duke
5,388,389 A 2/1995 Tisma
5,558,200 A 9/1996 Whitby et al.
5,607,045 A 3/1997 Hermann Kronseder
6,191,507 B1 2/2001 Peltier et al.
6,201,203 B1 3/2001 Tilles
6,209,710 B1 4/2001 Mueller et al.
6,421,984 B1 7/2002 Murgatroyd et al.
6,467,608 B2 10/2002 Stauber
6,733,224 B1 5/2004 Linner
6,811,019 B2 11/2004 Christian et al.
6,848,566 B2 2/2005 Harnish et al.
6,868,652 B2 3/2005 Arends et al.
6,876,107 B2 4/2005 Jacobs
6,904,733 B2 6/2005 Boix Jaen
7,093,408 B2 8/2006 Duperray et al.
7,134,258 B2 11/2006 Kalany et al.
7,146,784 B1 12/2006 Portrait
7,153,085 B2 12/2006 Clark et al.
7,309,203 B2 12/2007 Clark et al.
7,310,925 B2 12/2007 Monti
7,320,203 B2 1/2008 Monti
7,392,630 B2 7/2008 Ford
7,401,451 B2 7/2008 Bennett
7,401,453 B2 7/2008 Ford
7,461,838 B2 12/2008 Hendricks et al.
7,543,424 B2 6/2009 Lechner et al.
7,543,425 B2 6/2009 Monti
7,549,276 B2 6/2009 Monti
7,552,570 B2 6/2009 Raudat et al.
7,631,474 B2 12/2009 Ford
7,735,296 B2 6/2010 Momich
7,779,606 B2 8/2010 Ford
7,789,219 B2 9/2010 Baldanza et al.
7,803,099 B2 9/2010 Biraud et al.
7,806,250 B2 10/2010 Ford
8,033,082 B2 10/2011 Raudat et al.
8,096,409 B2 1/2012 Wipf et al.
8,322,514 B2 12/2012 Bonnain et al.
8,430,232 B2 4/2013 Baldanza et al.
8,448,777 B2 5/2013 Pazdernik
8,534,727 B2 9/2013 Weclawski et al.
8,671,651 B2 3/2014 Poutot
8,776,985 B2 7/2014 Huettner et al.
8,777,552 B2 7/2014 Ward et al.
8,876,182 B2 11/2014 Eidelberg et al.
8,903,540 B2 12/2014 Stork et al.
9,045,291 B2 6/2015 Konrad et al.
9,061,838 B2 6/2015 Van De et al.
9,199,757 B2 12/2015 Kolb
9,233,800 B2 1/2016 Senn et al.
9,309,016 B2 4/2016 Stork et al.
9,365,366 B2 6/2016 Girtman
9,403,611 B2 8/2016 Sacchetti et al.
9,457,970 B1 * 10/2016 Zevenbergen ..... B25J 9/0093
9,533,785 B2 * 1/2017 Rapp ..... B65G 59/02
9,540,127 B2 1/2017 Papsdorf et al.
9,546,049 B2 1/2017 Lindauer
9,573,771 B2 2/2017 Papsdorf et al.
9,580,253 B2 2/2017 Papsdorf et al.
9,604,792 B2 3/2017 Wipf
9,611,102 B2 4/2017 Job et al.
9,725,197 B2 8/2017 Pettersson et al.
9,731,854 B2 8/2017 Mann et al.
9,796,495 B2 10/2017 Boden et al.
9,802,507 B2 10/2017 Clark et al.
9,809,392 B2 11/2017 Walter et al.
9,856,092 B2 1/2018 Job et al.
9,873,571 B2 1/2018 Hahn
9,938,031 B2 4/2018 Shurtleff et al.
9,950,875 B2 4/2018 Walter et al.
9,957,072 B2 5/2018 Shurtleff et al.
9,963,258 B2 5/2018 Rapp et al.
9,988,166 B2 6/2018 Avril et al.
10,029,855 B2 7/2018 Grosskreuz et al.
10,106,331 B2 10/2018 Radak et al.
10,139,351 B2 11/2018 Piana et al.
10,150,219 B2 12/2018 Ridel et al.
10,161,970 B2 12/2018 Sun et al.
10,246,266 B2 4/2019 Weber et al.
10,287,105 B2 5/2019 Hayashi et al.
10,407,195 B2 9/2019 Sassi et al.
10,486,914 B2 11/2019 Choplin
10,604,291 B2 3/2020 Hutter et al.
10,669,049 B2 6/2020 Eberhardt et al.
10,696,488 B2 6/2020 Papsdorf et al.
10,717,606 B2 7/2020 Papsdorf et al.
10,766,650 B2 9/2020 Choplin et al.
10,773,847 B2 9/2020 Bellante
10,829,255 B2 11/2020 Aumann et al.
10,850,881 B2 12/2020 Langen et al.
10,882,704 B2 1/2021 Torrero
10,919,705 B2 2/2021 Papsdorf et al.
11,001,400 B2 5/2021 Kalany et al.
2001/0019006 A1 9/2001 Stauber
2003/0015402 A1 1/2003 Bennett
2003/0230941 A1 12/2003 Jacobs
2004/0017737 A1 1/2004 Yamamoto
2004/0262127 A1 12/2004 Harnish et al.
2005/0220582 A1 10/2005 Kumagai et al.
2006/0207220 A1 9/2006 Ford
2007/0119123 A1 5/2007 Clark et al.
2007/0152458 A1 7/2007 Guidetti
2008/0000756 A1 1/2008 Behnke et al.
2008/0196362 A1 8/2008 Monti
2008/0283361 A1 11/2008 Martini et al.
2009/0229227 A1 9/2009 Raudat et al.
2010/0084247 A1 4/2010 Wipf et al.
2010/0140052 A1 6/2010 Martini
2010/0192515 A1 8/2010 Chalendar et al.
2011/0150610 A1 6/2011 Weber
2011/0154784 A1 6/2011 Poutot
2011/0173930 A1 7/2011 Poutot
2011/0229297 A1 9/2011 Frazier et al.
2012/0085623 A1 4/2012 Wipf
2012/0261233 A1 10/2012 Huettner et al.
2014/0056684 A1 2/2014 Sydorko
2014/0262685 A1 9/2014 Job et al.
2014/0299445 A1 10/2014 Kolb
2014/0377049 A1 12/2014 Girtman
2015/0001041 A1 1/2015 Barber et al.
2015/0063963 A1 3/2015 Kinugawa
2015/0139772 A1 5/2015 Rapp et al.

(56) References Cited

U.S. PATENT DOCUMENTS

| | | | |
|---|---|---|---|
| 2015/0158611 | A1 | 6/2015 | Kalany et al. |
| 2015/0321857 | A1 | 11/2015 | Sacchetti et al. |
| 2016/0068290 | A1 | 3/2016 | Bonnain et al. |
| 2016/0107782 | A1 | 4/2016 | Hutter et al. |
| 2016/0221773 | A1 | 8/2016 | Corallo et al. |
| 2018/0186579 | A1 | 7/2018 | Choplin |
| 2018/0222608 | A1 | 8/2018 | Hutter et al. |
| 2019/0233151 | A1 | 8/2019 | Ford et al. |
| 2019/0255698 | A1 | 8/2019 | Zeiner et al. |
| 2020/0189779 | A1 | 6/2020 | Canalicchio et al. |
| 2020/0290815 | A1 | 9/2020 | Papsdorf et al. |
| 2020/0290816 | A1 | 9/2020 | Papsdorf et al. |
| 2021/0139176 | A1 | 5/2021 | Bonnain |
| 2021/0229847 | A1 | 7/2021 | Kalany et al. |

FOREIGN PATENT DOCUMENTS

| | | | |
|---|---|---|---|
| CN | 102666285 | A | 9/2012 |
| CN | 102905880 | A | 1/2013 |
| CN | 202729327 | U | 2/2013 |
| CN | 106660721 | A | 5/2017 |
| CN | 108674883 | A | 10/2018 |
| CN | 208216241 | U | 12/2018 |
| CN | 108454224 | B | 6/2020 |
| DE | 1236531 | B | 3/1967 |
| DE | 1981789 | U | 3/1968 |
| DE | 2824304 | A1 | 12/1978 |
| DE | 3709046 | C1 | 10/1988 |
| DE | 4142162 | A1 | 6/1993 |
| DE | 4208818 | A1 | 9/1993 |
| DE | 19602358 | C1 | 3/1997 |
| DE | 19628563 | A1 | 1/1998 |
| DE | 10121038 | A1 | 10/2002 |
| DE | 10346415 | A1 | 5/2005 |
| DE | 202005006755 | U1 | 10/2005 |
| DE | 102004026455 | A1 | 12/2005 |
| DE | 102005014863 | A1 | 10/2006 |
| DE | 202010001712 | U1 | 6/2011 |
| DE | 102010018153 | A1 | 10/2011 |
| DE | 102011016855 | A1 | 10/2012 |
| DE | 102011076864 | A1 | 12/2012 |
| DE | 102011015741 | B4 | 1/2013 |
| DE | 102011081705 | A1 | 2/2013 |
| DE | 102011083377 | A1 | 3/2013 |
| DE | 102011085724 | A1 | 5/2013 |
| DE | 202013105022 | U1 | 2/2014 |
| DE | 102014105998 | A1 | 2/2015 |
| DE | 102013111088 | A1 | 4/2015 |
| DE | 102014103632 | A1 | 9/2015 |
| DE | 102015203412 | A1 | 9/2015 |
| DE | 102015114654 | A1 | 3/2017 |
| DE | 102016211169 | A1 | 12/2017 |
| DE | 102016212227 | A1 | 1/2018 |
| DE | 102016212237 | A1 | 1/2018 |
| DE | 102016121361 | A1 | 5/2018 |
| DE | 202018103487 | U1 | 8/2018 |
| DE | 102016105570 | B4 | 1/2019 |
| DE | 102019107313 | A1 | 9/2020 |
| DE | 102020107427 | A1 | 9/2020 |
| DE | 102019204393 | A1 | 10/2020 |
| DE | 102019115198 | A1 | 12/2020 |
| EP | 0439741 | A1 | 8/1991 |
| EP | 0496046 | B1 | 1/1995 |
| EP | 0683131 | A2 | 11/1995 |
| EP | 0813494 | B1 | 9/1999 |
| EP | 1231145 | A1 | 8/2002 |
| EP | 1123886 | B1 | 8/2004 |
| EP | 1541508 | A1 | 6/2005 |
| EP | 1522402 | B1 | 6/2006 |
| EP | 1327591 | B1 | 11/2006 |
| EP | 1790593 | A1 | 5/2007 |
| EP | 1067048 | B1 | 8/2008 |
| EP | 2014559 | A1 | 1/2009 |
| EP | 1803665 | B1 | 5/2009 |
| EP | 1530541 | B1 | 7/2009 |
| EP | 1645340 | B1 | 10/2010 |
| EP | 2192063 | B1 | 4/2012 |
| EP | 2338795 | B1 | 10/2012 |
| EP | 2757043 | A1 | 7/2014 |
| EP | 2673224 | B1 | 1/2015 |
| EP | 2560904 | B1 | 4/2015 |
| EP | 2484611 | B1 | 9/2015 |
| EP | 2500296 | B1 | 2/2016 |
| EP | 2634100 | B1 | 2/2016 |
| EP | 2921433 | B1 | 9/2016 |
| EP | 3105017 | A1 | 12/2016 |
| EP | 3034415 | B1 | 3/2017 |
| EP | 3034441 | B1 | 4/2017 |
| EP | 3024737 | B1 | 7/2017 |
| EP | 2980010 | B1 | 8/2017 |
| EP | 2861496 | B1 | 9/2017 |
| EP | 3022138 | B1 | 10/2017 |
| EP | 3038959 | B1 | 11/2017 |
| EP | 2848382 | B1 | 12/2017 |
| EP | 2736834 | B1 | 2/2018 |
| EP | 3003927 | B1 | 3/2018 |
| EP | 3266718 | B1 | 7/2018 |
| EP | 3317186 | B1 | 7/2019 |
| EP | 3109998 | B1 | 8/2019 |
| EP | 3577046 | A1 | 12/2019 |
| EP | 3363751 | B1 | 4/2020 |
| EP | 3659932 | A2 | 6/2020 |
| EP | 3405395 | B1 | 7/2020 |
| EP | 3181495 | B1 | 11/2020 |
| EP | 3251986 | B1 | 1/2021 |
| EP | 3778439 | A1 | 2/2021 |
| EP | 3230181 | B2 | 7/2021 |
| EP | 3422562 | B1 | 10/2021 |
| FR | 3088842 | A1 | 5/2020 |
| GB | 1340427 | A | 12/1973 |
| GB | 2434356 | A | 7/2007 |
| IT | BO990370 | A1 | 1/2001 |
| IT | BO990484 | A1 | 3/2001 |
| JP | S54128282 | U | 9/1979 |
| JP | S6277149 | U | 5/1987 |
| JP | H05254644 | A | 10/1993 |
| JP | 2011025392 | A | 2/2011 |
| JP | 4762455 | B2 | 8/2011 |
| JP | 2018184294 | A | 11/2018 |
| RU | 2129980 | C1 | 5/1999 |
| RU | 2611851 | C2 | 3/2017 |
| WO | WO99036317 | A2 | 7/1999 |
| WO | WO00068087 | A2 | 11/2000 |
| WO | WO01085581 | A1 | 11/2001 |
| WO | WO2004024401 | A1 | 3/2004 |
| WO | WO2005070768 | A1 | 8/2005 |
| WO | WO2006098556 | A1 | 9/2006 |
| WO | WO2007033267 | A2 | 3/2007 |
| WO | 2008/015347 | A1 | 2/2008 |
| WO | WO2008036754 | A2 | 3/2008 |
| WO | WO2010120869 | A1 | 10/2010 |
| WO | WO2011127367 | A1 | 10/2011 |
| WO | WO2011138448 | A1 | 11/2011 |
| WO | WO2012057996 | A2 | 5/2012 |
| WO | WO2013005120 | A1 | 1/2013 |
| WO | WO2013185954 | A1 | 12/2013 |
| WO | WO2014072518 | A2 | 5/2014 |
| WO | WO2014118631 | A1 | 8/2014 |
| WO | WO2014187543 | A1 | 11/2014 |
| WO | WO2015101862 | A1 | 7/2015 |
| WO | WO2016012158 | A1 | 1/2016 |
| WO | WO2016012159 | A1 | 1/2016 |
| WO | WO2016069190 | A1 | 5/2016 |
| WO | WO2016069457 | A1 | 5/2016 |
| WO | WO2016146213 | A1 | 9/2016 |
| WO | WO2016188843 | A1 | 12/2016 |
| WO | WO2016200753 | A1 | 12/2016 |
| WO | WO2017167421 | A1 | 10/2017 |
| WO | WO2018049125 | A1 | 3/2018 |
| WO | WO2018144552 | A1 | 8/2018 |
| WO | WO2018145214 | A1 | 8/2018 |
| WO | WO2018161160 | A1 | 9/2018 |
| WO | WO2018193218 | A1 | 10/2018 |
| WO | WO2019007923 | A1 | 1/2019 |

(56) References Cited

FOREIGN PATENT DOCUMENTS

| | | | |
|---|---|---|---|
| WO | WO2019129968 | A1 | 7/2019 |
| WO | WO2020126218 | A1 | 6/2020 |
| WO | WO2020146486 | A1 | 7/2020 |
| WO | WO2020244951 | A1 | 12/2020 |

OTHER PUBLICATIONS

ABB Robotics, "Picking and packing salami snacks," <https://www.youtube.com/watch?v=aPTd8XDZOEk> YouTube publication date Apr. 19, 2010.

All Packaging Company, "Folding Carton continuous printing at up to 20k sheets per hour," <https://www.youtube.com/watch?v=Bc8ZnHukvN0> YouTube publication date Mar. 3, 2013.

Bastian Solutions, "High-Speed Pick & Place Robots by Basitan Solutions," <https://www.youtube.com/watch?v=6RKXVefE98w> YouTube publication date Apr. 3, 2012.

BluePrint Automation, "20237 BluePrint Automation (BPA) Robotic Pick & Place Case Packer (Model: Robotic Top Loader," <https://www.youtube.com/watch?v=RjxTeuyaH_Q> YouTube publication date Apr. 13, 2012.

Bobst, "Bobst Ambition folder-gluers," <https://www.youtube.com/watch?v=EvLkFkz-Uv0> YouTube publication date Jan. 29, 2015.

Packagingspace, "Cama Group complete packaging lineup.mpg," <https://www.youtube.com/watch?v=6uTnz59b4H8> YouTube publication date May 16, 2011.

Packfeeder, "Robotic bottle unscrambler—Pickfeeder Twin 200," <https://www.youtube.com/watch?v=ueiOqVip7-c> YouTube publication date Dec. 11, 2018.

Professional Packaging Systems, "A-B-C 450 High Speed Case Erector and Bottom Sealer / ProPac.com," <https://www.youtube.com/watch?v=w6w9psSstKA> YouTube publication date Sep. 3, 2010.

STAX Technologies, "Case packer + palletizer," <https://www.youtube.com/watch?v=YtNft4FYkDw> YouTube publication date May 6, 2015.

International Search Report and Written Opinion for Application No. PCT/EP2020/071431 dated Oct. 9, 2020 (11 pages).

Office Action received for Chinese Patent Application No. 202080068655.6, mailed on Nov. 24, 2023, 10 pages (4 pages of English Translation and 6 pages of Original Document).

* cited by examiner

DENESTING APPARATUS

CROSS REFERENCE TO RELATED APPLICATIONS

This application is a national stage filing under 35 U.S.C. § 371 of International Patent Application No.: PCT/EP2020/071431, filed Jul. 29, 2020, which claims priority to European Patent Application No. 19189073.0, filed Jul. 30, 2019 and European Patent Application No. 19219765.5, filed Dec. 27, 2019, the entire contents of which all are hereby incorporated by reference herein.

TECHNICAL FIELD

The present invention relates generally to a denesting apparatus for denesting one or more stacks of sheets.

BACKGROUND

In the recent years, there has been a many-fold increase in the trend of grouping large number of items such as food items, including liquid foods, home essentials, stationary items, beverage containers, and the like, in the form of secondary packages, for various purposes such as to enable bulk selling, easy transportation, handling, and the like.

Recently there has been a considerable increase in use of cardboard based packaging for holding liquid foods and beverages which resulted in an increase in the manufacture of cardboard packaging or cartons in a variety of shapes and sizes.

Cardboard based packaging is generally formed of foldable blank or sheets, received generally in one or more stacks and therefore, during the packaging manufacturing process, it is required to sequentially and individually de-stack or unstack these blanks or sheets from the stacks thereof which are then fed on to a packing process for formation of various kinds of packaging.

Conventionally, the step of de-stacking these blanks or sheets has been performed by utilizing various kind of pickers such as for example, manipulators, which may also take the form of robots and/or robotic arms, adapted to pick up a top sheet from the stack intermittently. Unfortunately, such pickers are often not cost-efficient and have a high turn-around time and therefore do not reconcile well at instances where a continuous in-feed of these sheets at a high speed is required.

Accordingly, numerous efforts have been imparted to produce tools that de-stack sheets from the stacks individually, sequentially and at a high speed. Examples include various mechanical assemblies including so called fingers and/or grippers adapted to lift and/or pull away either the uppermost or lowermost sheet from the stack. However, these fingers and grippers based pulling mechanisms were generally adapted to pull either a fixed size sheet or at least having similar shape and/or size convenient to be handled by such fingers or grippers. Additionally, such devices may result in high rates of rejection since the sliding contact of these pulling devices frequently damages the sheets.

While it is usually desirable to provide a system which de-stacks sheets of material as quickly as possible, it is also important that the same de-stacking apparatus may be utilized for a variety of shapes and sizes of sheets. To overcome the problems of mechanical assemblies, various kind of air-nozzle based de-stacking mechanisms were introduced.

For example, WO2008015347 discloses the use of a retractable blower member disposed generally perpendicularly to a stack of sheets so as to blow a jet of air onto the flat items thereby removing the top sheet from the stack thereof.

Similarly, US20110229297 discloses a denesting apparatus having a product carrier plate including a pair of air nozzle assemblies operable to separate a tray from the stack of trays and force the tray against the product carrier plate such that movement of the product carrier plate can selectively discharge the separated tray.

However, these air nozzle-based side blowing mechanisms are generally not effective in un-stacking sheets having different thickness. Further, in most instances, these de-stacking mechanisms uncontrollably dislodged more than one sheet, which is not acceptable particularly in an automated system.

Therefore, various other solutions were tried out to denest the top sheet from stacks thereof. Recently, the trend has been shifting towards use of a variety of suction mechanisms for performing the denesting operation. These mechanisms generally utilize suction mechanisms either singly or in conjunction with air nozzles.

For example, EP1541508 discloses a device for the de-stacking of flat objects laid on a stack. The device has a suction device located above the stack support, and a pushing away device with pushing components. The suction device and pushing away device are located at a fixed distance above the stack support, and the pushing components on their end face facing the stack support during the pushing away of an object from the suction head of the suction device have a stop for the next object lifted from the stack by the suction head. U.S. Pat. No. 3,401,831 discloses a denester which, in addition to the suction grippers, includes nozzles which blow pressurized air between the outermost tray and the tray immediately succeeding it, in order to facilitate their separation. Such suction mechanism utilizes suction heads/nozzles which further requires vacuum hoists/supply to create negative air pressure for suction. Therefore, these arrangements are often overly complex in design, and were also undesirably slow in their operation.

Recently, various kind of de-stacking means or cups-based mechanisms have been utilized due to their simple structure and designs. For example, as disclosed in U.S. Pat. No. 5,254,071, these mechanisms generally include a drive mechanism with a vacuum cup which is alternatively brought close, put into contact then moved away from the stack of sheets. The vacuum cup is laid against the top sheet of the stack and then carries away the top sheet to bring it away from the stack before laying it down on another work area, for example, on a packaging 20) line conveyor.

In some other variations, de-stacking means were utilized to pick the sheet/tray from bottom as described in US20140056684 which discloses a tray denesting apparatus presenting stacks of trays placed upside down within a storage area to a picker mechanism and separating single trays from the stack of trays. A de-stacking means is used to remove individual trays from the tray stack. After picking up the individual tray, a driven rotary device inverts the tray and places the tray onto a tray conveyor located beneath the denesting apparatus.

However, all such packaging apparatuses have certain shortcomings as well. Firstly, these de-stacking means based mechanisms utilize drive mechanisms adapted to pick up and denest the sheets in accordance to a predetermined distance setting from a predetermined stack. Such system is, however, not designed for cases where a same packaging is a combination of different kind of sheets, such as e.g. a package blank combined with a partition blank.

Accordingly, as can be understood from the foregoing discussion, none of the existing solutions completely provides flexibility of varying the de-stacking operation in accordance to varying requirements of multiple stacks simultaneously while preventing suspending the operation. Thus, in the context of the above, it is desirable to provide a denesting device that overcomes these problems associated with the prior art, is affordable, and allows to carry out de-stacking of multiple stacks of different packaging material blanks or sheets of varying configurations, size, shape, material and caliper in the desired manner, without requiring to change functional elements thereof.

SUMMARY

In one aspect of the invention, a denesting apparatus for denesting sheets of foldable blanks from one or more stacks thereof is provided. The denesting tool includes one or more closed loop conveying tracks comprising a plurality of sets of de-stacking means movingly configured thereon through a de-stacking means moving mechanism. The denesting apparatus further includes one or more stacking magazines each adapted to hold one or more stacks of sheets to be denested. In operation, each of the plurality of sets of de-stacking means is adapted to selectively engage an uppermost sheet from at least one of the stacking magazines and discharge it onto an out-feed conveyor. The picking up of the sheets from the one or more stacks may be performed in various desired order either sequentially or otherwise simultaneously so as to discharge the picked-up sheets in any desired manner either one besides another or in an overlapping manner i.e. one over the other.

Generally, the de-stacking means of attachment to the packaging material sheet or blank, may be a conventionally known suction cup and/or vacuum cup having a generally bell-shaped structure and formed of a generally soft material such as a rubber, silicon, and the like, that is impenetrable by air, or may be any of a number or means of temporarily attaching (holding on to) an article including methods of pin, clamping, magnetic, static electric, Van Der Waals force, Bernoulli contactless suction, to name a few.

Optionally, the de-stacking means moving mechanism includes a plurality of de-stacking lugs, each adapted to movingly engage one of the sets of one or more de-stacking means through an engagement means.

Further optionally, each of the de-stacking lugs is movingly configured onto one of the closed loop conveying tracks through one or more de-stacking movers movingly configured thereon.

In a specific embodiment, the denesting apparatus comprises one, or two or more, generally parallel closed loop conveying tracks which are horizontally adjustable in pitch and in absolute position relative to the machine datum and wherein the de-stacking means moving mechanism includes a plurality of de-stacking lugs movingly configured onto the parallel closed loop conveying tracks through one or more de-stacking movers movingly configured thereon and wherein the de-stacking movers on the parallel closed loop conveying tracks are independently controlled to achieve controlled elevation or loweration whilst in translation of the picked-up sheet.

Possibly, the engagement means may be any conventionally known mechanism suitable for supporting one or more de-stacking means onto the de-stacking lugs and is selected from one or more of, but not limited to, a supporting plate. Alternatively, the engagement means includes an articulating engagement assembly to movingly engage one of the sets of one or more de-stacking means onto the one or more de-stacking lugs, and adapted to provide generally a perpendicular and/or transversal movement along with a longitudinal movement, enabling a picking up a sheet from one of the stacking magazines.

Possibly, the articulating engagement assembly includes an articulated bracket having a first end connected to a first de-stacking mover through a first de-stacking lug, a second open end connected to a second de-stacking mover through a second de-stacking lug and a pivotally movable center end connected to a supporting plate having one or more de-stacking means configured thereon, such that a longitudinal movement of the de-stacking movers towards and/or away from each other enables a generally perpendicular movement to the supporting plate and in turn to the one or more de-stacking means so as to pick up a sheet positioned at a distance thereto. So by changing the relative distance between the first and second de-stacking movers, the position of the de-stacking means relative to the uppermost sheet to be picked-up (ie so-called picking plane) may be adjusted.

In another embodiment, possibly, the articulating engagement assembly includes an articulated bracket having a first end connected to a first de-stacking mover through a first de-stacking lug, a second end connected to a second de-stacking mover through a second de-stacking lug and third end connected to a third de-stacking mover through a third de-stacking lug and a pivotally movable center end connected to a supporting plate having one or more de-stacking means configured thereon, such that a longitudinal movement of the de-stacking movers towards and/or away from each other enables a generally perpendicular movement to the supporting plate and also control of the angle of approach, contact and translation of the supporting plat and picking means with the picking plane of the destacking mechanism, so as with the additional degree of freedom to optimize the contact, attach and accelerate away with the packaging material blank there so picked.

Further possibly the supporting plate is a generally horizontally rotatable plate facilitating rotation of the sheet picked up by the one or more de-stacking means.

In an embodiment of the present invention, the de-stacking means movement mechanism may be adapted for moving the de-stacking means horizontally upon picking the uppermost sheet before lifting it. The horizontal movement before liftingtending to fly the sheet off the following and tending to establish an air gap thus enhancing the separation of the sheets.

In a particular embodiment in accordance with the present invention, the denesting apparatus may further comprise a means for forcing the underside of a picked-up sheet against a means for applying friction in reverse direction relative to conveying direction onto the underside of the uppermost sheet. The means for forcing may be an air blower blowing on the top side of the picked sheet that the underside of the sheet is cause to bear up against a means for applying friction such as a reverse spinning wheel or belt. By forcing the underside of the picked sheet against a means for applying reverse acting friction, any tendency for one or more sheets to follow the picked-up sheet is counter-acted such that any duplicated sheets are pushed back into the enclosure of the magazine.

In another embodiment, the denesting apparatus comprises two of said closed loop conveying tracks in parallel and a movement mechanism for varying the distance between said two parallel tracks and their position relative to the datum of the machine, thereby enabling to pick sheets of various size and enabling where on the different sized and shaped sheet to attach during the picking operation.

Optionally, the one or more stacking magazine is a vertically movable supporting rack adapted to move between a top position $P_T$ and a bottom position $P_B$ using a vertical movement mechanism.

Further optionally, the vertical movement comprising a vertical rail comprising one or more stacking movers movingly configured thereon and each of the stacking movers engaging the supporting rack using a connecting member such that the stacking member is movable between the top position $P_T$ and the bottom position $P_B$ through the stacking movers.

Alternatively, the vertical movement mechanism may be any suitable movement mechanism.

Possibly, the top position $P_T$ of the stacking magazine is positioned at a height $H_T$ away from a base platform, corresponding to the base position $P_B$, such that a top sheet of the stack is positioned at a height $H_S$ suitable to be picked up by at least one of set of the de-stacking means.

Generally, the denesting apparatus further includes a retractable lifting means positioned over the one or more stacking magazine and adapted to support at least a sub-stack of sheets such that the top sheet of the corresponding sub-stack is positioned at the height $H_S$ suitable to be picked up by at least one of the de-stacking means.

Further, the retractable lifting means is adapted to be vertically movable such that after removal of the top sheet, the next top sheet is always positioned at the height $H_S$ suitable to be picked up by the one or more de-stacking means.

Furthermore, the retractable lifting means is configured to retract back and move back to its base position, once each of the sheets supported thereon is picked up by the one or more de-stacking means.

Additionally, the retractable lifting means is further configured to open and pick up another sub-stack of the sheets at its base position.

Possibly, the apparatus further includes an infeed conveying line connected to the one or more stacks such that as soon as an empty magazine is received at its bottom position, it gets replenished with new stack of sheets.

Optionally, the stacking magazine may be a horizontally moving conveyor.

Optionally, the one or more closed loop conveying tracks, the lifting plate, and the one or more stacking magazines are adapted to move at a predetermined pitch so as to denest the stacks of the one or more sheets onto the out-feed conveyor continuously.

Alternatively, the one or more closed loop conveying tracks, the lifting plate, and the one or more stacking magazines are adapted to move intermittently at a variable pitch as required, so as to denest the stacks of the one or more sheets onto the out-feed conveyor intermittently.

Preferably, the vertical movement of the stacking magazine is configured in such a way that when the lifting plate is in its retracted position, the stacking magazine is in its top position such that the top sheet is positioned at the height $H_S$ suitable to be picked up by the one or more de-stacking means.

Optionally, the denesting apparatus includes a first powering means enabling a movement of each of the one or more closed loop conveying tracks, the infeed conveyor, the retractable lifting means, the stacking magazine and the out-feed conveyor.

Further optionally, the first powering means may be selected from one or more of but not limited to various conventionally known linear motors, asynchronic motors, machines, servo drives, and the like conventionally known in the art.

Possibly, each of the plurality of movers on the closed loop conveying tracks is individually powered by a second powering means, preferably a linear motor, utilizing each of the movers as a rotor thereof and the corresponding track as a stator thereof. Alternatively, any other type of driving means adapted to propel the movers in an independent and controlled way may be used.

Alternatively, the second powering means may be selected from one or more of, but not limited to, various conventionally known asynchronic motors, machines, servo drives, and the like, conventionally known in the art.

In addition, the de-stacking means and the de-stacking moving mechanism may be wirelessly powered, for example via sliding contacts on the de-stacking movers, and preferably contactless powered, for example by providing inductive power to the de-stacking movers. Further, the de-stacking means and its moving mechanism may be wirelessly controlled, including but not limited to short range wireless, such as Bluetooth, Infrared, Microwave, WLAN, narrow through broadband telecommunication and the like, preferably in combination with wirelessly powering. Wireless machine control and contactless power supplies enable highly flexible, large range, untethered movement and motion controlled operation of the recirculating de-stacking means to achieve efficient denesting operations.

Particularly, the sheet of foldable blank is formed of a material selected from one or more of, but not limited to paperboard, corrugated board, thermoplastic, hybrid material, laminated board and the like.

Possibly, the denesting apparatus further comprises a control unit for optimizing the movement of the one or more closed loop conveying tracks, the one or more de-stacking means, the one or more stacking magazines, the retractable lifting means, and the incoming conveying line.

Further possibly, the control unit includes one or more sensors, one or more input units, a processor unit and an output unit.

In a particular embodiment, the apparatus may comprise one or more sensors enabling real-time, inline measurement of the distance between the de-stacking means and the uppermost sheet of a magazine to be picked up and a control unit to dynamically control and adjust the position and reach of the de-stacking means for optimum performances.

In further particular embodiment in accordance with the present invention, the denesting apparatus may comprise two closed loop conveying tracks, and one or more sensors may measure the position of the picked-up sheet, preferably of its leading edges, while moving it onto the out-feed conveyor, and a control unit may control and adjust the position of the de-stacking movers of the respective closed loop conveying tracks relative to each other to correct any angular and/or translational mis-alignment of the picked-up sheet.

The denesting apparatus may comprise two one or more sensors enabling real-time, inline measurement of the angular and position alignment of any picked sheet or packaging material blank and a control units to dynamically adjust the relative positions of the mover mounted denesting mechanisms opposite each other between the generally parallel closed loop tracks, or controlled rotation of the denesting mechanism, to dynamically correct any angular or translational error.

Further, de denesting apparatus may comprise one or more sensors enabling real-time, inline detection of a double or more sheet pick and the activation of means of pressing the picked sheet against the said reverse acting friction device to counter the multi-sheet pick and return the excess to the stacking magazine. The sensor would also enable detection of any no-pick, invoking appropriate remedial action within the overall product loading functions of the machine.

In yet another aspect of the invention, a method of denesting one or more stacks of sheets, each supported onto a corresponding stacking magazine, using the denesting apparatus of the present invention, is provided. The method includes receiving one or more stacks of sheets of a predetermined material. The method further includes picking up a top sheet from the one or more stacks in a predetermined manner either sequentially or otherwise simultaneously. The method further includes placing the picked-up sheet onto the out-feed conveyor in any desired manner, either one besides the other or otherwise one over the other.

Optionally, the method includes rotating the picked-up sheet before placing it onto the out-feed conveyor.

Optionally, the method includes forming, folding, stretching or otherwise shaping the picked-up sheet before placing it onto the out-feed conveyor or, merging or assembling it with another packaging material already picked within the Denesting System.

Optionally, the step of picking up the one or more sheets from the one or more stack includes the step of contacting at least the one or more de-stacking means, with one of the stacks such that the top sheet of the stack is picked up by the corresponding de-stacking means.

Optionally, the method includes picking one sheet at a time sequentially.

Alternatively, the method includes picking more than one sheet at a time simultaneously.

Further alternatively, the method includes dropping the simultaneously picked up sheet either simultaneously one besides other or otherwise sequentially one over the other.

Possibly, the method includes moving the each of the one or more or more pair of de-stacking lugs together in a predetermined sequence of vertical movement and/or transversal movement and/or longitudinal movement, so as to position the corresponding de-stacking means in contact with the top sheet of the desired stack of sheet.

Further possibly, the pushing sequence is determined by the control unit on the basis of an input from a user and/or input from one or more sensors.

Other aspects, features and advantages of the subject matter disclosed herein will be apparent from the description, the drawings, and the claims.

DETAILED DESCRIPTION

The present application discloses a denesting apparatus, for picking up sheets individually from one or more stacks in any desired order and discharging them onto an out-feed conveyor in any desired manner. The denesting apparatus while being efficient, is able to de-stack sheets from multiple stacks having sheets of different shapes, sizes, material and caliper (thickness) without requiring any changes in the functional elements thereof. Further, the sheets may be picked up either simultaneously or otherwise sequentially and may be dynamically discharged in a synchronized manner, on to an out-feed conveyor, with the sheets placed either one besides another or otherwise one over another, either continuously or otherwise intermittently and in varying configurations, speeds, and the like, without making any physical change within the apparatus.

Figure 1:
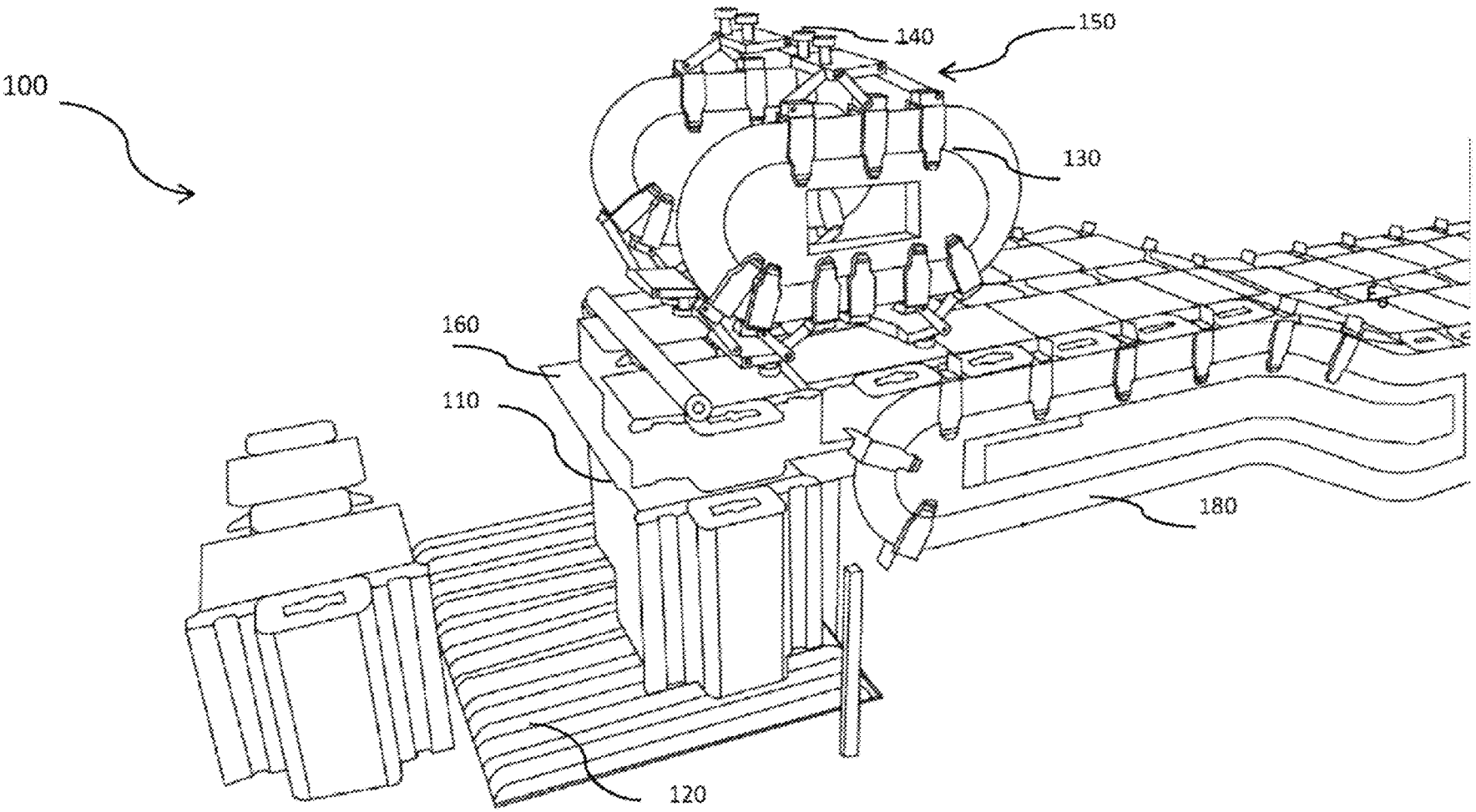
FIG. 1 illustrates a schematic diagram representing a denesting apparatus, in accordance with a preferred embodiment of the present invention.

As illustrated in FIG. 1, the present invention provides a denesting apparatus 100 for de-stacking one or more stacks of sheets 110 individually and delivering them in a synchronized fashion onto attachment means (not shown) of an out-feed conveyor 180.

The denesting apparatus 100 includes one or more overhead closed loop conveying tracks 130 comprising a plurality of sets of de-stacking means 140 movingly configured thereon, through a de-stacking means moving mechanism 150. The denesting apparatus 100 further includes one or more stacking magazines 120, each adapted to support one of the one or more stacks of sheets 110. Further, each of the stacking magazines 120 is connected to an incoming conveying line (not shown) carrying a supply of stacks of sheets 110. The denesting apparatus 100 furthermore includes a retractable lifting mechanism 160 adapted to support at least a sub-stack of the stack of sheets 110 such that a top sheet is positioned at a height suitable to be picked up by at least one of the sets of de-stacking means 140. In operation, the one or more stacks of sheets 110 are first positioned onto the one or more stacking magazines 120. Thereafter, one or more sets of the de-stacking means 140 is movingly positioned towards the one of the one or more stacks 110 such that the top sheet from at least one of the stacking magazines 120 is picked up in any desired order, and discharged towards the out-feed conveyor 180 in any desired manner.

Figure 2:
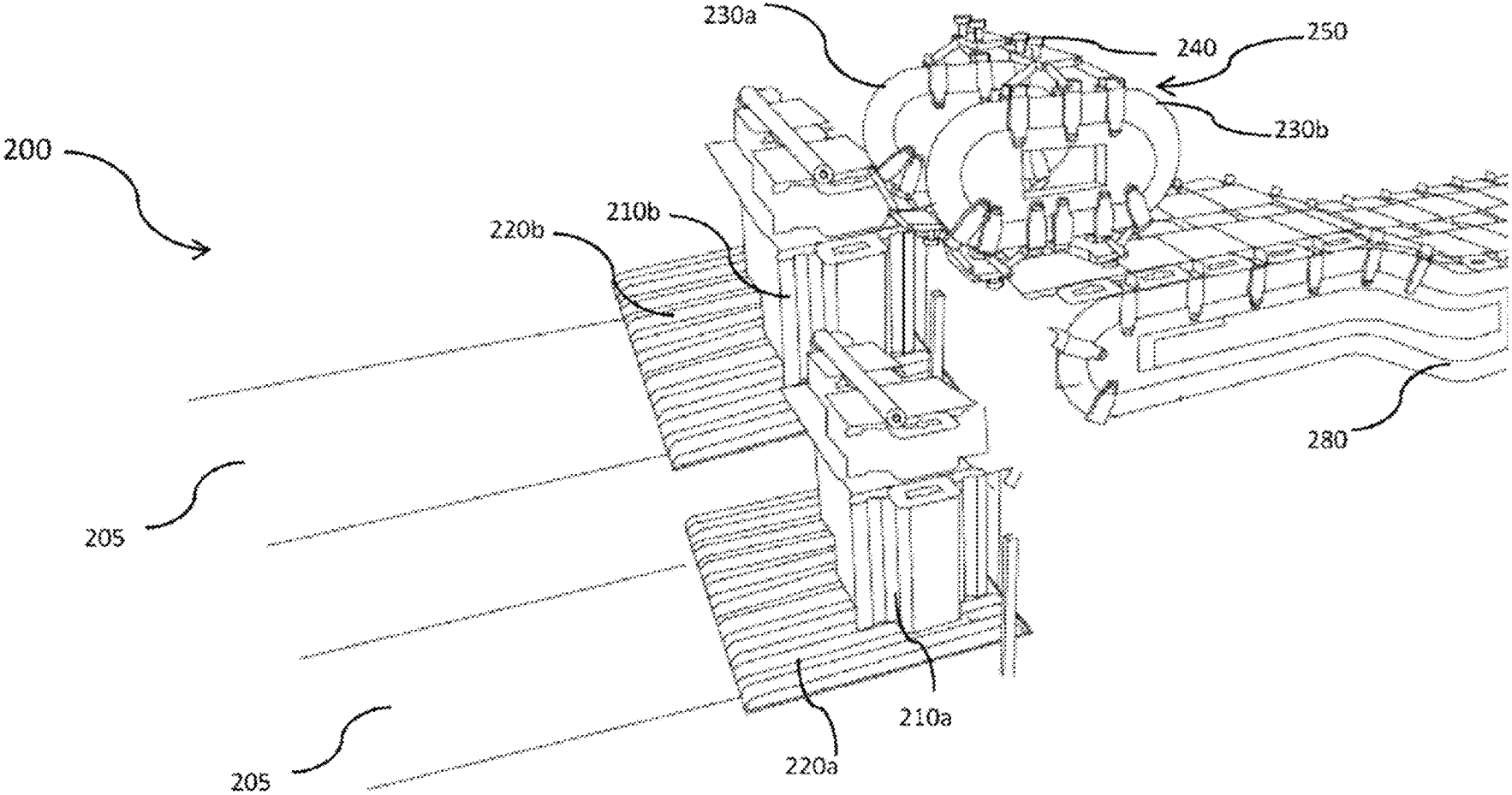
FIG. 2 illustrates a schematic diagram representing another exemplary denesting apparatus, in accordance with another preferred embodiment of the present invention.

In description of the FIG. 2 that follow, elements common to the schematic system will have the same number designation unless otherwise noted. In a first preferred embodiment, as illustrated in FIG. 2, an exemplary denesting apparatus 200 having a single closed loop conveying track 230 for denesting one or more stacks of sheets 210, including a first stack 210*a* positioned onto a first stacking magazine 220*a*, and a second stack 210*b* positioned onto a second stacking magazine 120*b*, onto an out-feed conveyor 280.

Figure 4A:
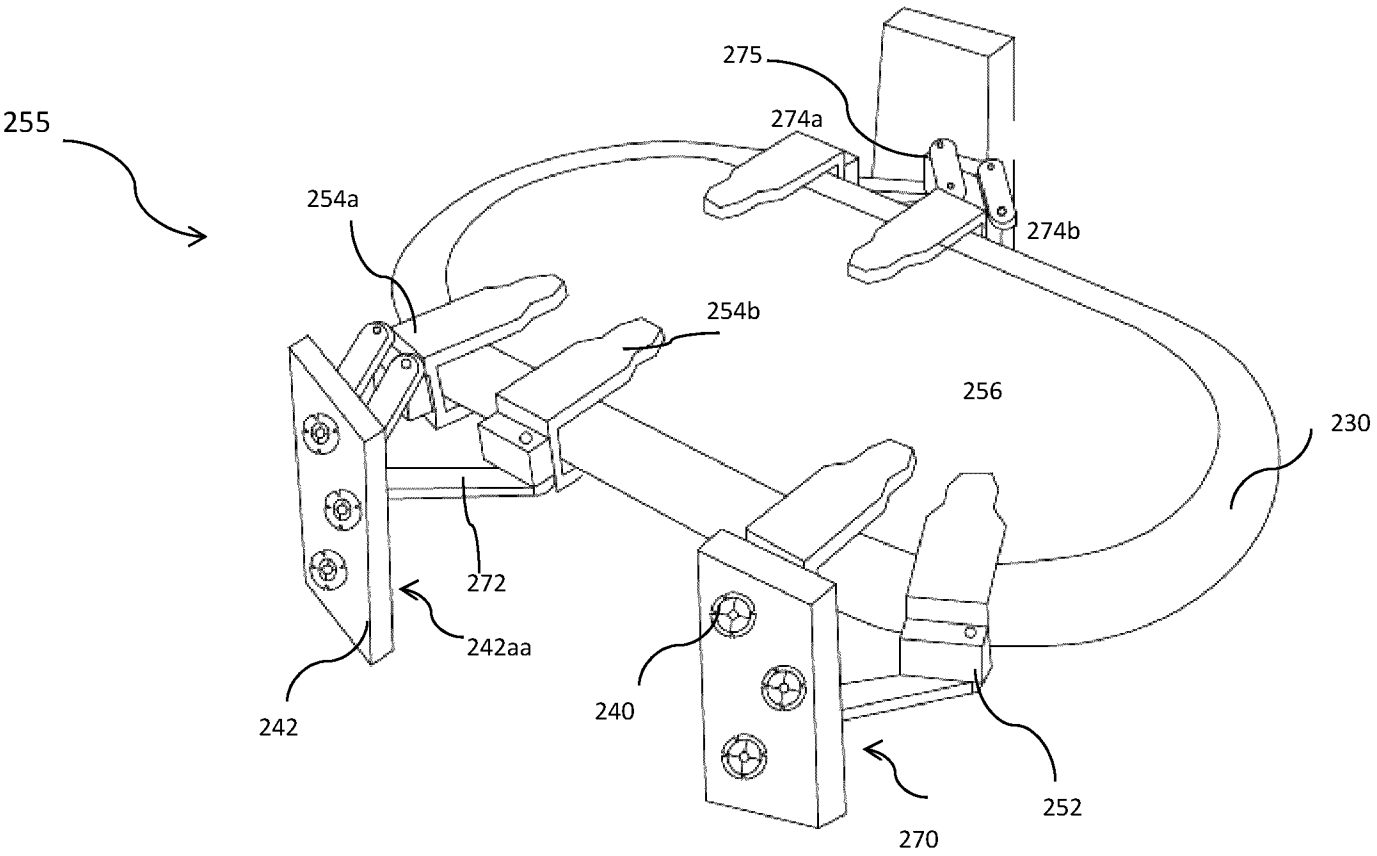
FIG. 4*a* illustrates a perspective view diagram representing an exemplary engaging means, in accordance with the preferred embodiment of the present invention.
Figure 4B:
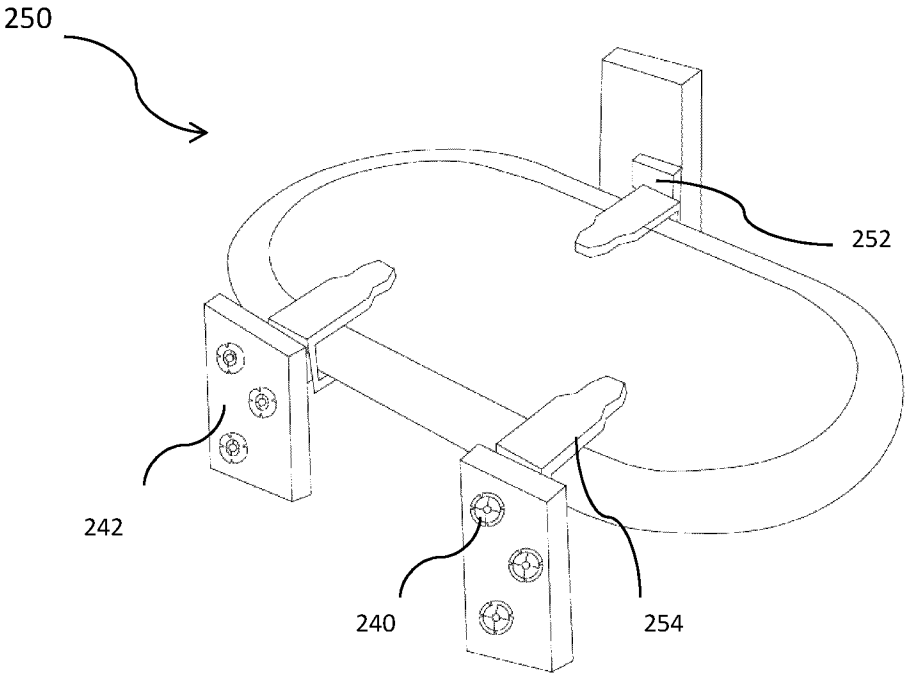
FIG. 4*b* illustrates a perspective view diagram representing another exemplary engaging means, in accordance with another embodiment of the present invention.
Figure 5:
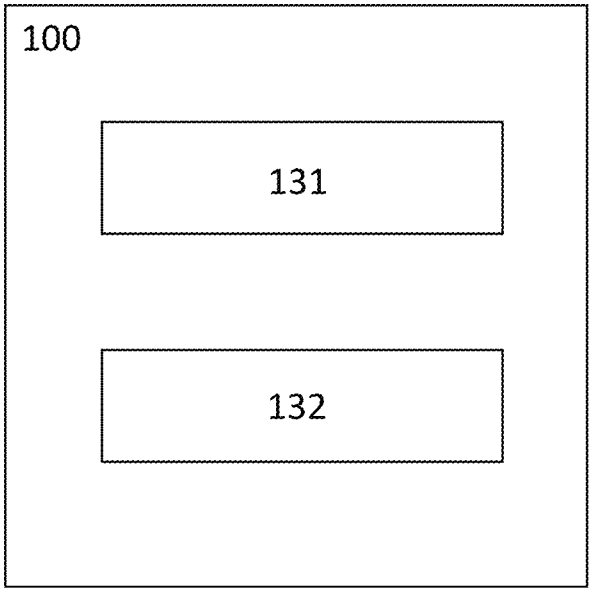
FIG. 5 illustrates a schematic diagram representing the exemplary denesting apparatus, in accordance with another preferred embodiment of the present invention.

The closed loop conveying track 230 includes a plurality of sets of one or more de-stacking means 240 movingly configured thereon through a de-stacking means moving mechanism 250. The de-stacking means moving mechanism 250 includes a plurality of de-stacking lugs 252 (FIGS. 5A, 5*b*), each movingly configured onto the closed loop conveying track 230 through a de-stacking mover 254 (FIGS. 4A, 4*b*). Further, each of the de-stacking lugs 252 is adapted to engage to at least one of the sets of de-stacking means 240 through an engagement means 255 (FIG. 4*a*). In a preferred embodiment of the present invention, the engaging means 255 includes an articulating engagement assembly 270 to movingly engage one of the sets of one or more de-stacking means 240 onto one or more de-stacking lugs 252. In such an embodiment, each set of the one or more de-stacking means 240 is positioned onto a supporting plate 242, having a first side 242*a* connected to a pair of de-stacking movers 254*a*, 254*b*, pivotally and movably attached to each other through one or more articulated mounting brackets 272. The articulated bracket 272 is a conventionally known mounting bracket and includes a first attachment bracket 274 connected to a second attachment bracket 276 at their distal ends at a connection point C such that the articulated bracket has three open ends, i.e. a first open end 274*a* at a proximal end of the first attachment bracket 274, a second open end 276*a* at the proximal end of the second attachment bracket 276 and a pivotally movable center end 275 at the connection point C.

Further, as illustrated in FIG. 4*a*, the articulated movement assembly 270 includes a first de-stacking mover 254*a* connected to a second de-stacking mover 254*b* through the articulated mounting brackets 272, each of the movers 254*a*, 254*b* connected at one of the open ends 274*a*, 274*b* of the articulated bracket 272, such that the articulated bracket 272 is pivotally movable in a generally perpendicular plane to the track throughout the longitudinal range of motion of the first mover 254*a* and the second movers 254*b*, towards and/or away from each other. The articulated assembly 270 is connected to the first side 242*a* of the supporting plate 242 at the pivotally movable center end 275 thereof.

In a collapsed position, where the articulated mounting bracket 272 is closed, such that each of the pair of pivotally connected de-stacking movers 254*a*, 254*b* are oriented in a substantially coinciding position, the supporting plate 242 is at its initial position. In an opened position, where the articulated mounting bracket 272 opens up pivotally, the pair of the movers 254*a*, 254*b* may be moved towards or away from each other such that the corresponding supporting plate 242 is moved perpendicular to the track which the movers traverse along, i.e. upward or pivotally towards or away from corresponding de-stacking lugs 252*a*, 252*b*.

One skilled in the art will recognize that the articulated movement assembly 270 having the pair of movers 254*a*, 254*b* is pivotally connected for longitudinal movement in a generally horizontal plane in a conventional manner. The articulated movement assembly 270 is movingly supported on to the closed loop conveying track 230 such that a horizontal longitudinal movement of the movers 254*a*, 254*b* towards and away from each other is possible. Such a movement of the pair of movers 254*a*, 254*b* provides operative power for enabling the movement of the mounting bracket 272 between its collapsed position and its open position, thereby enabling a range of vertically upward and pivotal extensions 20) along with a longitudinal movement of the shaping supporting plate 242 onto the closed loop conveying track 230.

Therefore, by appropriate manipulation of the first mover 254*a* and the second mover 254*b* and therefore the articulated assembly 270, the supporting plate 242 and the corresponding set of de-stacking means 240 may be positioned at any desired distance away from the de-stacking lugs 252, while moving in an operative orientation generally in a vertical and/or transversal and/or horizontal direction.

In yet other embodiments, the engagement means 255 may be any conventionally known mechanism suitable for supporting the set of one or more de-stacking means 240 onto the de-stacking lugs 252 and is selected from one or more of but not limited to a supporting plate as illustrated in FIG. 4*b*

In a modification of the first embodiment, as illustrated in FIG. 2, the denesting apparatus 200 includes multiple and preferably a pair of overhead closed loop conveying tracks 230 namely 230*a*, 230*b* for denesting one or more stacks 210 including a first stack 210*a* positioned onto a first stacking magazine 220*a*, and a second stack 210*b* positioned onto a second stacking magazine 220*b*.

In such an embodiment, the individual movement of the sets of de-stacking means 240 of each of the tracks 230*a*, 230*b* may be utilized to speed up the process by utilizing either as a dedicated track 230 for predetermined stacks 210 or otherwise in situations where there is a need of simultaneously pick up and drop down of the sheets within stacks 210 onto the out-feed conveyor 280. In yet other embodiments, de-stacking means 240 of both the tracks may be adapted to sequentially or simultaneously pick up the top sheet from the same stack 210. In yet other embodiments, the sets of de-stacking means of the pair of tracks 230*a*, 230*b* may be utilized in any possible manner so as to de-stack one or more, stacks 210, onto the out-feed conveyor 280.

This embodiment is particularly advantageous due to the fact that it provides multiple closed loop conveying tracks 230 and therefore the de-stacking means 240 each powered by a single light weight powering means for managing the operation of the denesting apparatus 200 and therefore is considered as a further efficient way to implement various embodiments of the present invention.

FIG. 2 schematically show the arrangement of the basic components of the denesting apparatus 200 of the present invention. However, in the construction of commercial functional units, secondary components such as couplers, connectors, support structures and other functional components known to one of skill in the field of denesting apparatuses and more particularly the denesting of foldable blanks for use with conveyor systems, may be incorporated within the denesting apparatus 200. Such commercial arrangements are included in the present invention as long as the structural components and arrangements disclosed herein are present. Accordingly, it is to be contemplated that the denesting apparatus 200 may be configured to be used for any kind of foldable blank of any possible shapes as deems possible without deviating from the scope of the current invention.

In a preferred embodiment, the one or more stacks of sheets 210 may be formed of a plurality of sheets in the form of foldable blanks, each adapted to form a primary or secondary package and/or a component thereof. For example, and as illustrated in FIG. 2, the first stack 210*a* positioned onto the first stacking magazine 220*a* may be stack of plurality of blanks each adapted to form a box shaped secondary package. Further, the second stack 210*b* positioned onto the second stacking magazine 220*b* may be a stack of plurality of partition sheets, each adapted to form a partition for the box shaped secondary package. However, in other embodiments, the stack of sheets 210, may include any number of stacks of sheets, adapted to form any kind of output product, to be denested using the apparatus 200 of the present invention. Each of the stacking magazines 220*a*, 220*b* is connected to an incoming conveying line 205 each carrying a supply of stack of sheets 220*a*, 220*b* respectively.

In an embodiment and referring to FIGS. 3*a*-3*d*, the stacking magazines 220 are generally vertically movable storage racks 222 adapted to move between a top position $P_T$ and a bottom position $P_B$ through a vertical movement mechanism 224. The top position $P_T$ is positioned at a height $H_T$ away from a base platform corresponding to the base position $P_B$, such that the top sheet of the stack 210 is positioned at a height $H_S$ suitable to be picked up by at least one set of the de-stacking means 240.

Further in such embodiments, in preferred instances, as illustrated in FIG. 3, the vertical movement mechanism 224 includes a vertical rail (not shown) positioned besides the storage rack 222 having one or more stacking movers 226 movingly configured thereon, and adapted to engage the storage rack 222 using a connecting member (not shown) such that the storage rack 222 is movable between its top position $P_T$ and the bottom position $P_B$ through the stacking movers 226.

However, in other instances, the vertical movement mechanism 224 may be any suitable movement mechanism.

The denesting apparatus 200 further includes a retractable lifting means 260, illustrated in FIGS. 3*a*-3*d* positioned over each of the one or more stacking magazines 220 and adapted to support at least a sub-stack of the sheets, such that the top sheet is positioned at the height $H_S$ suitable to be picked up at least by one set of the de-stacking means 240 of the one or more closed loop conveying tracks 230.

Figure 3A:
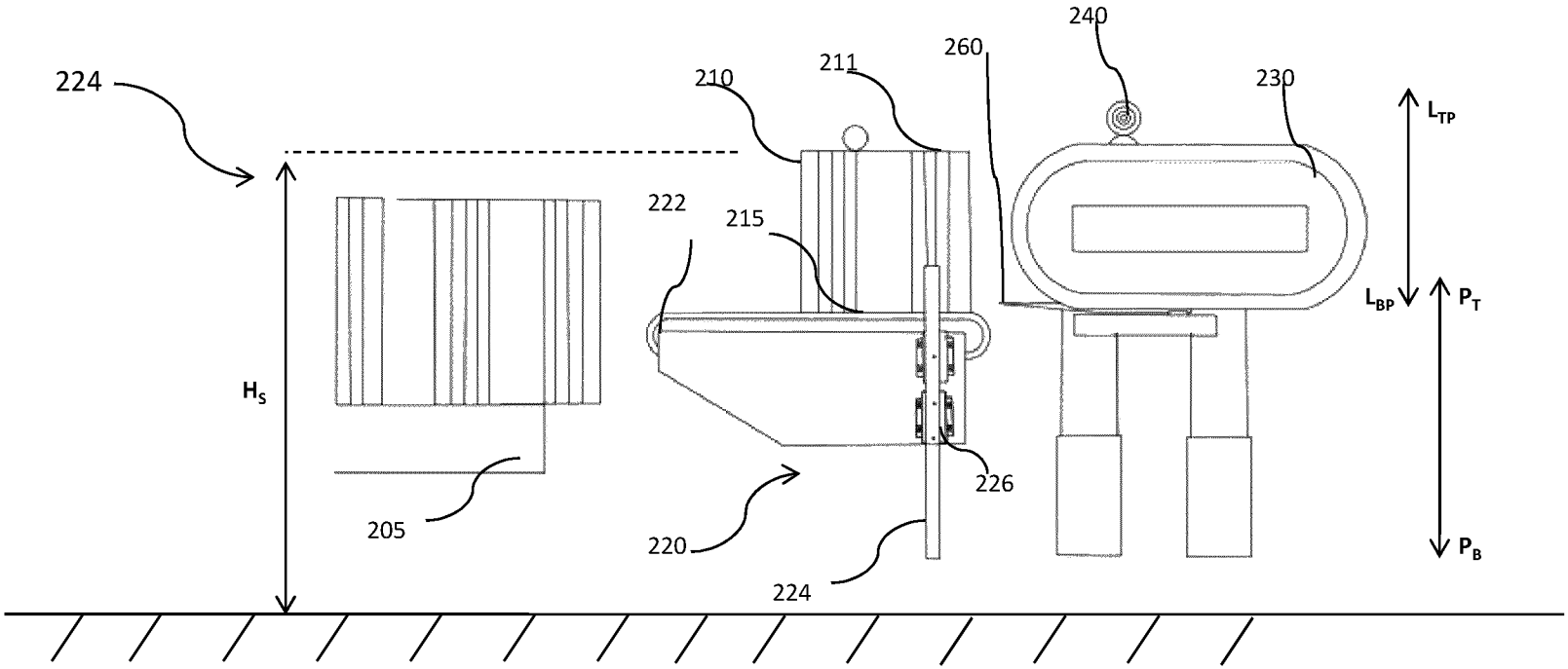
FIGS. 3*a*, 3*b*, 3*c*, 3*d* illustrate a front view diagram representing the exemplary denesting apparatus at different steps, in accordance with a preferred embodiment of the present invention.
Figure 3B:
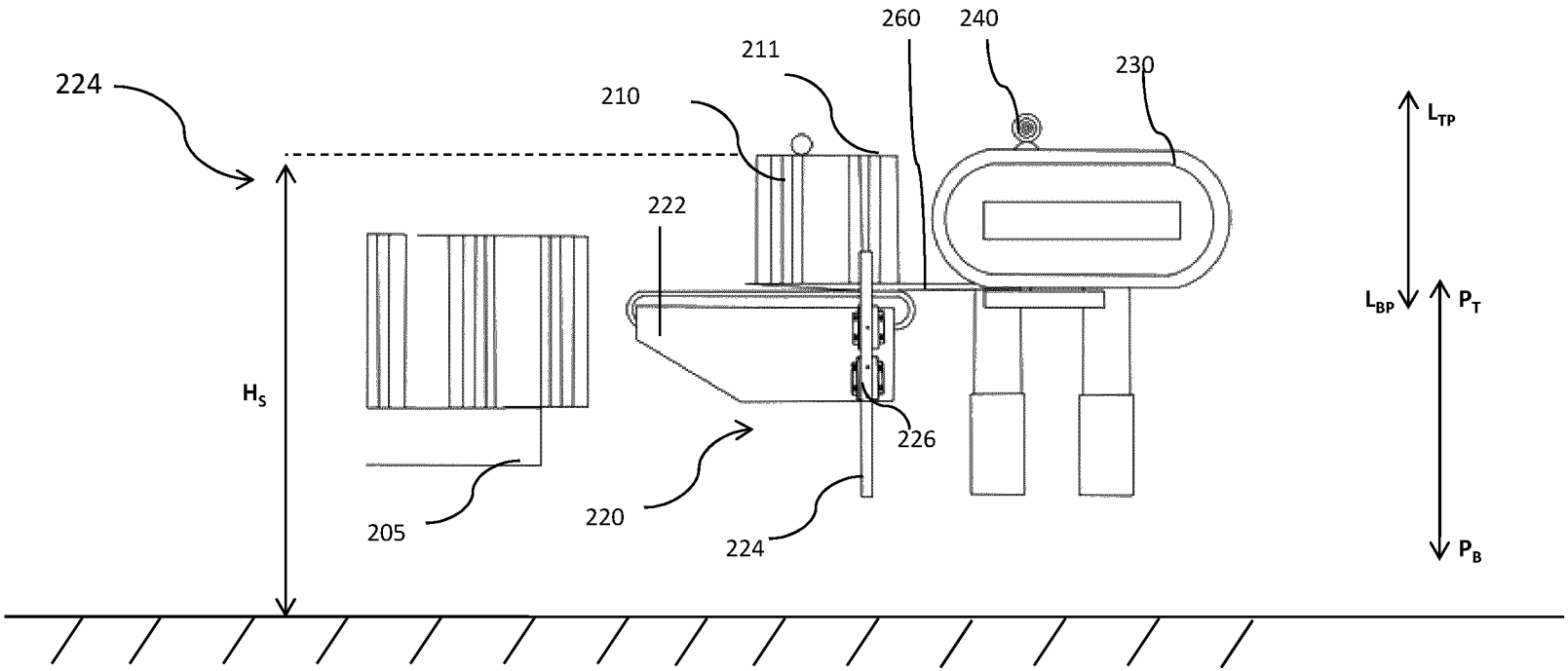
Figure 3C:
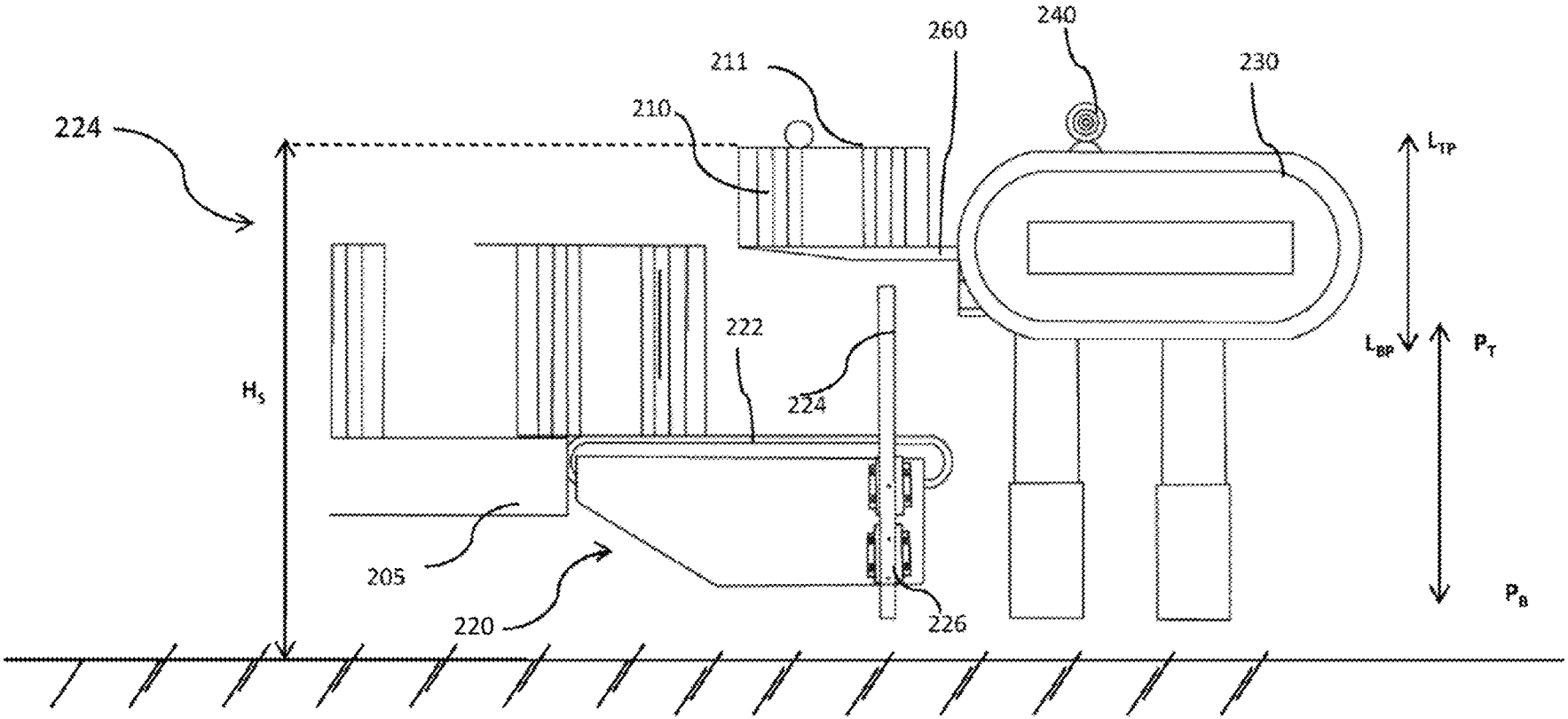
Figure 3D:
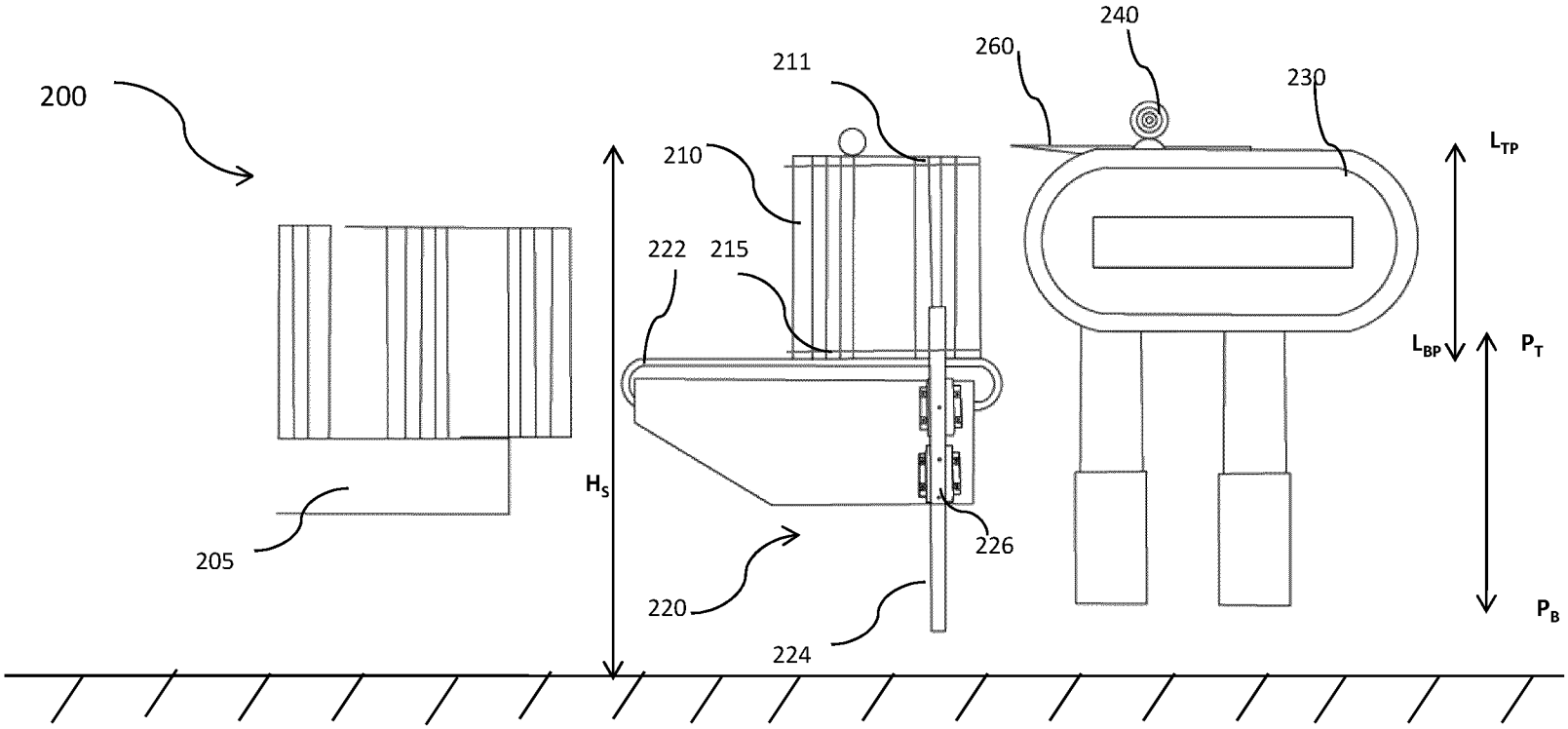

In an embodiment, the retractable lifting means 260 is generally a flat lifting plate and is moveable vertically between a base position LBP and a top position $L_{TP}$ thereof, such that at any moment the top sheet is made to be positioned at the $H_S$ suitable to be picked up by at least one set of the de-stacking means 240. Further, the retractable means 260 is movable between an open position Po and a retracted position PR (not shown). Such lifting plate may alternatively also consist of a plurality of forks that may move away or towards each other In some instances, as illustrated in FIG. 3*a*, the base position LBP of the retractable lifting means 260 is generally same as the top position $P_T$ of the storage rack 222 of the stacking magazine 220 such that when moved to open position Po from the retracted position PR, the retractable lifting means 260 supports the entire stack 210 thereon. Further, in such instances, the lifting means 260 moves vertically with removal of each top sheet to a distance same as a thickness of the sheet such that the top sheet is always positioned at the height $H_S$. The top position $L_{TP}$ of the lifting means 260 is such that a bottommost sheet 215 (FIG. 3*d*) of the stack 210 is positioned as the top sheet. Once the stack 210 has been completely denested, lifting means 260 is adapted to retract back to the retracted position PR and vertically move down to the base position LBP.

The out-feed conveyor 280 is generally an outgoing conveyor positioned substantially below the one or more closed loop conveying track 230 at a height $H_C$ from the base platform, substantially similar to the height $H_T$ of the top sheet such that the already pick up top sheet may be suitably dragged and/or dropped onto the out-feed conveyor 280 for further processing.

The denesting apparatus 200 further includes a first powering means for enabling a movement of the one or more closed loop conveying tracks 230, the in-feed conveyor 205, each of the one or more stacking magazines 220, the retractable lifting mechanism 260, the out-feed conveyor 280 and various sub-components thereof. In a preferred embodiment, the first powering means is a linear servo motor 131 adapted to move each of the one or more closed loop conveying tracks 230, the in-feed conveyor 205, each of the one or more stacking magazines 220, the retractable lifting mechanism 260, the out-feed conveyor 280 at a first predetermined pitch facilitating a continuous operation of each of the components of the denesting apparatus 200 such that the incoming supply of the stacks of sheets 210 is continuously denested and transferred onto the out-feed conveyor 280 in any desired order and in any desired manner. However, in other embodiments, the first powering means is a linear servo motor 131 adapted to move each of the one or more closed loop conveying tracks 230, the in-feed conveyor 205, each of the one or more stacking magazines 220, the retractable lifting mechanism 260, the out-feed conveyor 280 at a dynamically adjustable variable pitch facilitating an intermittent operation of each of the components of the denesting apparatus 200 such that the incoming supply of the stacks 210 of the sheets is denested and transferred onto the out-feed conveyor 280, intermittently and when desired.

The denesting apparatus 200 further includes a second powering means 132*f* or enabling controlled independent movement of each of the movers including the de-stacking movers 254, and optionally the stacking movers 226 along the corresponding tracks and/or rails. In a preferred embodiment, the first powering means is linear servo motor 131 or equivalent thereof providing independent motion control of each mover. In such an embodiment, the linear motor 131 is a generally moving magnet type of motor conventionally known in the art. Further in such embodiments, the linear motor 131 utilizes the corresponding tracks and/or rails as a stator and each of the movers as a rotor thereof.

In other embodiments, the movers 254, 226 are utilized as stator whereas the tracks or rails are utilized as the rotors. In such an embodiment, each of the movers 254, 226 may include built in coils and each of the corresponding tracks or rails may include magnets configured thereon in a longitudinal direction such that the movers are able to come into an electromagnetic interaction, thereby enabling a movement thereof.

The denesting apparatus 200 may further include one or more control units (not shown) for managing the operations thereof, and particularly for managing the working of the first powering means and/or the second powering means 132 and more particularly the movement of the de-stacking movers 254*a* and *b*, so as to optimize the sequence of the longitudinal and/or vertical and/or transversal movement of the supporting plate 242, and therefore the one or more support pads 240, in a predetermined sequence. The predetermined sequence is particularly required to be evaluated in the instances where a specific predetermined order has to be followed for picking up the top sheets 211, from the one or more stacks 210.

In some embodiments, the control unit may include an input unit for receiving inputs related to the predetermined order of denesting the stacks 210 and the desired manner of discharge of the already picked up top sheets 211, onto the out-feed conveyor 280. Further, the control unit may include a plurality of sensors (not shown) for tracking the parameters such as for example, position, width and/or height of the of the sheets or blanks to be discharged, sheet or blank mis-alignment, for sensing when the one or more stacks 210 is empty, for sensing if the lifting means reached its top position, and the like. The control unit may further include a processor unit for processing the data captured by the input unit on the basis of predetermined logics/rules for facilitating the movement of the plurality of movers 254, 226, the vertical movement of the stacking magazine 220, and the retractable lifting mechanism 260. The control unit may further include an instruction unit that delivers the instructions to various components such as various powering means, linear motors, motors, driving units, or the like, to facilitate a desired and smooth operation.

In some embodiments, the control unit may be provided as a computer program product, such as may include a computer-readable storage medium or a non-transitory machine-readable medium maintaining instructions interpretable by a computer or other electronic device, such as to perform one or more processes.

In some embodiments, each of the plurality of sheets of the stack 210 is generally formed from a recyclable material selected from one or more of but not limited to any desired material such as including all kind of papers, fiberboard, corrugated board, foldable blanks, hybrid material, laminated board or any combinations thereof. Further, the shape and size, including the thickness of the sheets or blanks, and surface finish, may be varied depending on the design constraints and requirements for its application. In some other embodiments, the sheets or blanks may be made of a lightweight plastic material selected from one or more of, but not limited to, plastic material such as group of thermoplastics including acetal, acrylic, cellulose acetate, polyethylene, polystyrene, vinyl, and nylon. In yet other embodiments, the sheets or blanks may be made of any material suitable to be denested using the denesting apparatus 200, of the present invention.

In an embodiment, the one or more de-stacking means 240 is formed of a conventionally known suction cup and/or vacuum cup having a generally bell-shaped structure and formed of a generally soft material such as a rubber, silicon, and the like, that is impenetrable by air. As may be contemplated by a person skilled in art, such de-stacking means 240 has been vastly utilized for lifting an object by application of vacuum created there within, when applied with a force against a flat surface such as a sheet. The number, size, and dimension of such de-stacking means 240, is determined on the basis of weight, dimensions, and material of the sheets or blanks to be picked up from the stack 210. In some embodiments, where the sheet or blank is of a heavy material, the denesting apparatus 200 may further be provided with a supply of negative pressure, for example, in the form of a vacuum creator, which may be utilized by de-stacking means 240 for picking such heavy sheets.

In a particular embodiment, variable suction force or vacuum at the point of application, at any location about the picking cycle may be applied for enabling faster cycle times. Further, control of the suction force or vacuum may avoid sheet material distortion and avoid the suction effect acting through porous materials and influencing optional other materials behind the porous primary material of the sheet.

In another embodiment, the air flow to the suction or vacuum cups may be reversed at discharging the sheet, thereby rapidly cancelling out the vacuum and applying a fast discharge force.

It is to be contemplated that while the number of stacks 210 has been mentioned as two in exemplary embodiments, the present invention may be utilized for any number of stacks without deviating from the scope of disclosure and depending upon the design constraints of the package to be formed. For example, in some instances, the one or more stacks 210 may include a first stack 210*a* of foldable blank of carton, a second stack 210*b* of a partition for the carton, a third stack 210*c* holding sheet for forming a handle of the carton and so on. In other embodiments, the denesting apparatus 200 may be used to denest only a single stack 210. In all such embodiments, the number of stacking magazines 220 remains equal to number of stacks 210 so as to individually support the stacks 210 thereon.

In a preferred embodiment of the present invention, each of the conveyors of the denesting apparatus 200 including the one or more closed loop conveying tracks 230, the in-feed conveyor 205, and the receiving conveyor 280 is generally a vertically positioned closed loop conveying track conventionally known in the art. In other embodiments, each of the conveyors of the denesting apparatus 200 including the one or more closed loop conveying tracks 230, the in-feed conveyor 205, and the out-feed conveyor 280 may be a generally horizontal positioned closed loop conveying track. In yet other embodiments of the present invention, each of the conveyors of the denesting apparatus 200 including the one or more closed loop conveying tracks 230, the in-feed conveyor 205, and the receiving conveyor 280 may be configured as a virtual closed loop conveyor.

The virtual closed loop conveyor, as known in the art, is generally a closed loop conveyor similar to a circular conveyor, in which the circular connecting edges of the conveyors on both the ends are replaced by straight shiftable conveyor portions adapted to move back and forth and avoiding the need of moving the movers through the entire circumference of the closed loop conveying track, and is therefore a very fast alternative to the conventionally known closed loop conveying tracks. Further, the closed loop conveyor being made of longitudinal rails, is therefore much more cost efficient than any conventionally known closed loop conveying tracks and/or conveyors. Additionally, the back and forth movement may also be helpful in providing additional pressure while performing operations such as pushing operation is therefore further preferred.

While the stacking magazine 220 has been disclosed to be a generally vertically movable supporting rack 222, in some embodiments, the stacking magazine 220 may be inclined to the vertical or otherwise a horizontal conveyor (not shown) adapted to receive a supply of stacks 210 of the sheets or blanks such that the top sheet of one of the stack 210 is positioned at a distance suitable to be picked up by the one or more de-stacking means 240. Further, once the stack 210 is nearly exhausted, another stack 210 is positioned at the distance suitable to be picked up by the one or more de-stacking means 240 such that there is no interruption there between.

In use, as disclosed earlier, the denesting apparatus 200 is adapted to be positioned onto an input line of a package manufacturing unit provided with one or more stacks 210 of foldable blanks for forming generally box shaped secondary packages. The denesting apparatus 200 denests the foldable blanks from the one or more stacks 210 placed onto the one or more stack magazines 220 in any predetermined order and places onto the out-feed conveyor 280 in any desired manner. Each of the stacks 210 is denested in a generally top to bottom manner, however, not restricted to any particular way of denesting and therefore it is contemplated that the denesting apparatus of the present invention may be utilize to perform denesting operation in any possible way without deviating from the scope of the present invention.

Figure 6:
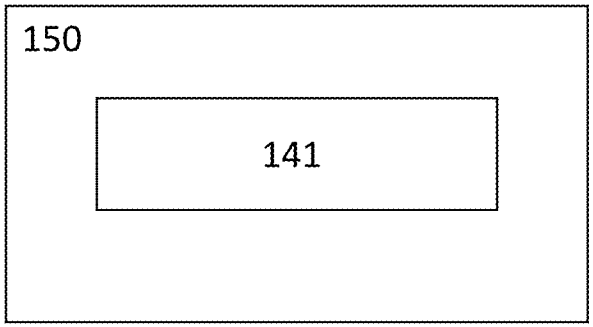
FIG. 6 illustrates a schematic diagram representing the exemplary denesting apparatus, in accordance with another preferred embodiment of the present invention.

FIG. 6 is a particular embodiment in accordance with the present invention, the denesting apparatus 100 comprising the de-stacking means and the de-stacking means moving mechanism are wirelessly powered and wirelessly controlled 141.

The present invention relates to a denesting apparatus 200 for continuously and/or intermittently at a constant and/or variable speed, de-stacking sheets individually from one or more stacks in any desired order and discharging them onto an out-feed conveyor in any desired manner.

Additionally, the possibility of providing different kind of pushing sequence to the one or more sets of de-stacking means 240 allows picking up the top sheets 211 in any desired order and discharging in any desired manner. Such an optimized and focused picking up and dropping down the sheets in addition to a complete control of the speed, direction of the placement of the sheets, allows the possibility of using a same conveying line for discharging multiple sheets together while utilizing the width of the out-feed conveyor and avoiding misalignment and therefore, any damage to the sheets being discharged there through.

Particularly, the present invention is additional advantageous in providing an input line of packaging apparatus of different sub-parts of the packages, in accordance with the predetermined shape and configurations of the packages to be achieved.

Further, the denesting tool is adaptable to different dimensions of foldable blanks and is therefore well suitable to process packages of different sizes and shapes with ease and efficiently and not requiring changing the entire apparatus for denesting sheets of different predetermined shapes and sizes.

Further, the present invention provides the possibility of manufacturing the conveyor system with integrally formed denester apparatus 200. Such a conveyor system for forming secondary package, while being cost-efficient, is very quick and easy to use and offers comfortable handling of packages of any shape, size or any variety of configurations.

Additionally, since the denester apparatus of the present invention while being applicable onto the conveyor system, does not impact the rest of the conveying process. A single conveyor system may utilize as many as denesting apparatuses within the same arrangement. Further, in case of one denesting apparatus is not working, rest can keep working and therefore, the fault tolerance of the plant can be increased.

While the denesting apparatus 200 of present invention has been disclosed with reference to foldable blanks, it may be used to denest all currently known sheet types, e.g., constructed of materials such as thermoplastic, hybrid materials, woven metallic fabric that may include ferrous or nonferrous metals, etc., or any other suitable material. Even in instances where heavy sheets are to be picked up, the strength or number of de-stacking means 240 may be adapted in accordance without having to change the entire apparatus 200.

Moreover, it is also contemplated for a person skilled in the art that the denesting apparatus 200 of the present invention may be implemented in various industries such as food industry, transport industry, house hold appliance industry in denesting of any kind of product or group of products, of any shape, size or any variety of configurations, without limiting it to the packaging industry.

The invention claimed is:

1. A denesting apparatus, the apparatus comprising:

one or more closed loop conveying tracks, each closed loop conveying track comprising a plurality of sets of a plurality of de-stacking means movingly configured thereon through one or more de-stacking means moving mechanism; and one or more stacking magazines, each adapted to hold a stack of sheets supported thereon;

wherein each of the plurality of sets of de-stacking means is adapted to selectively engage an uppermost sheet from at least one of the one or more stacking magazines so as to discharge picked-up sheets onto an out-feed conveyor; wherein the denesting apparatus is configured to discharge the picked-up sheets on to an out-feed conveyor in a plurality of manners, including one besides another and otherwise one overlapping the other;

wherein the de-stacking means are selectively engaged by an engagement means having an articulating engagement mechanism;

wherein the articulating engagement mechanism comprises:

a supporting plate adapted to fixedly support one or more de-stacking means thereupon; and a pivotally movable mounting bracket having a first open end connected to a first articulated mover, a second open end connected to a second articulated mover and a pivotally movable central end connected to the supporting plate; and wherein a longitudinal movement of the first articulated mover and the second articulated mover towards and/or away from each other enables a generally perpendicular movement of the supporting plate relative to the rail system of the movers.

2. The apparatus of claim 1, comprising one, or two or more parallel closed loop conveying tracks and wherein de-stacking means moving mechanism includes a plurality of de-stacking lugs movingly configured onto the one, or two or more parallel multiple closed loop conveying tracks through one or more de-stacking movers movingly configured thereon and wherein the de-stacking movers on the parallel closed loop conveying tracks are independently controlled to achieve translation of the picked-up sheet.

3. The apparatus of claim 2, comprising a powering means for enabling a movement of each of the plurality of movers including the de-stacking movers and stacking movers of the stacking magazines wherein further the powering means for enabling a movement of each of the plurality of movers is selected from a linear motor, servo motors and synchronic and/or asynchronic motor drives.

4. The apparatus of claim 2, wherein the de-stacking means and the de-stacking means moving mechanism are wirelessly powered and wirelessly controlled.

5. The apparatus of claim 1, comprising a first powering means for enabling a movement of the closed loop conveying tracks, wherein the first powering means is a linear motor.

6. The apparatus of claim 1, wherein each of the plurality of sets of de-stacking means is adapted to selectively engage an uppermost sheet from two or more stacks of sheets of at least one of the one or more stacking magazines in any desired order either sequentially or simultaneously so as to discharge the picked-up sheets onto an out-feed conveyor; wherein the denesting apparatus is configured to discharge the picked-up sheets on to an out-feed conveyor in a plurality of manners, including one besides another and otherwise one overlapping the other.

* * * * *